US011203099B2

(12) United States Patent
Muniswamappa et al.

(10) Patent No.: US 11,203,099 B2
(45) Date of Patent: Dec. 21, 2021

(54) MULTIPLE-SLOPE OR MULTIPLE-OFFSET TOOL MECHANISM

(71) Applicants: Anjanappa Muniswamappa, Ellicott City, MD (US); Si Li, Cantonsville, MD (US); Muneer Baig, Riyadh (SA); Ashwini Anjanappa, Ellicott City, MD (US)

(72) Inventors: Anjanappa Muniswamappa, Ellicott City, MD (US); Si Li, Cantonsville, MD (US); Muneer Baig, Riyadh (SA); Ashwini Anjanappa, Ellicott City, MD (US)

( * ) Notice: Subject to any disclaimer, the term of this patent is extended or adjusted under 35 U.S.C. 154(b) by 240 days.

(21) Appl. No.: 16/288,942

(22) Filed: Feb. 28, 2019

(65) Prior Publication Data

US 2019/0358795 A1 Nov. 28, 2019

Related U.S. Application Data

(63) Continuation of application No. 15/361,236, filed on Nov. 25, 2016, now abandoned, which is a continuation of application No. 14/287,952, filed on May 27, 2014, now abandoned, which is a continuation of application No. 13/030,548, filed on Feb. 18, 2011, now abandoned.

(60) Provisional application No. 61/398,353, filed on Jun. 24, 2010, provisional application No. 61/403,686, filed on Sep. 20, 2010.

(51) Int. Cl.
*B25B 23/142* (2006.01)

(52) U.S. Cl.
CPC ..... *B25B 23/1427* (2013.01); *Y10T 29/49718* (2015.01); *Y10T 29/49826* (2015.01)

(58) Field of Classification Search
CPC ..... B25B 23/1427; Y10T 29/49718; Y10T 29/49826
See application file for complete search history.

(56) References Cited

U.S. PATENT DOCUMENTS 9,421,675 B2 * 8/2016 Yu ..... B25B 23/141

* cited by examiner

*Primary Examiner* — Hadi Shakeri
(74) *Attorney, Agent, or Firm* — Clifford Kraft

(57) ABSTRACT

Use of multiple-slope and/or multiple-offset mechanism or equivalent to address the issues with current mechanical clickers that have single-slope spring mechanism. The varying-slope can be a continuously varying-slope non-linear spring, or a combination of discretely varying multiple-slope springs. This inventior is useful for clicker type torque wrenches, clicker type torque screw drivers, beam type torque wrenches, beam type torque screw drivers and shock absorbers. The present invention is equally applicable to clickers that click in both the CW (clockwise) and CCW (counterclockwise) directions or clickers that click only in one direction. The invention is generally characterized by placing a non-linear spring or combination of springs in the tool body to achieve multiple slope operation rather than using one single slope spring.

3 Claims, 18 Drawing Sheets

MULTIPLE-SLOPE OR MULTIPLE-OFFSET TOOL MECHANISM

This is a continuation of application Ser. No. 15/361,236 filed Nov. 25, 2016 which was a continuation of application Ser. No. 14/287,952 filed May 27, 2014 which was a continuation of application Ser. No. 13/030,548 filed Feb. 18, 2011 which claimed priority from U.S. provisional applications Nos. 61/398,353 filed Jun. 24, 2010 and 61/403,686 filed Sep. 20, 2010. Application Ser. Nos. 14/287,952, 13/030,548, 61/398,353 and 61/403,686 are hereby incorporated by reference in their entireties. Application Ser. No. 15/361,236 is also hereby incorporated by reference in its entirety.

BACKGROUND

Field of the Invention

The present invention relates generally to self-adjusting mechanisms used in torque wrenches and torque screwdrivers, and more particularly to multiple-slope and/or multiple-offset spring mechanisms that exhibit non-linear behavior for use in such tools.

Description of the Prior Art

In many applications such as torque wrenches, shock absorbers, etc. the ability to adjust the characteristic behavior of the mechanism as the applied load is varied will enable the new generation of mechanisms. Torque wrenches are commonly used to tighten fasteners to a desired torque. The fasteners used to assemble performance critical components require tightening to a specific 'torque' level to introduce a "pretension" in the fastener. The torque is often applied to the head of the fastener, which causes the fastener to stretch. This stretch results in pretension of the fastener, which is the force that holds the joint together. The most economical and popular method is to use torque wrenches. A good quality joint can be achieved if an accurate and reliable torque wrench is available. The prior art torque wrenches could be as simple as a simple mechanical type to a sophisticated electronic type. The mechanical types are generally less expensive and are not as accurate as more expensive electronic torque wrenches.

There are two common types of mechanical torque wrenches, clicker and beam types. With a beam type torque wrench, the beam bends in response to the torque applied. The clicker type torque wrench works by preloading a snap mechanism with a spring to release at a specified torque generating a click noise. The clicker type is sometimes called a digital wrench since the set torque many times shows up as a numerical number on a dial.

Clicker torque wrenches (for example spring-based models) with a presettable torque level are primarily based on a single-slope and single-offset compression spring mechanism. This single-slope mechanism limits the attainable accuracy of the current clickers. Another problem with the current clickers is that they tend to lose their accuracy quickly and require recalibration often. This leads to increased maintenance cost and down time.

It would be advantageous to provide a torque wrench mechanism that combines varying-slope and varying-offset to overcome these problems.

Non-linear spring combinations using series and parallel springs with different "K" factors (spring constant in pounds per inch) are known in the art; however, they have not been used in torque wrenches and like tools.

SUMMARY OF THE INVENTION

The present invention generally uses a multiple-slope and/or multiple-offset mechanism or equivalent to address the issues with current mechanical clickers that have single-slope spring mechanism. The varying-slope can be a continuously varying-slope non-linear spring, or a combination of discretely varying multiple-slope springs. This invention is useful for many applications, especially for clicker type torque wrenches, clicker type torque screw drivers, beam type torque wrenches, beam type torque screw drivers and shock absorbers. The present invention is equally applicable to clickers that click in both the CW (clockwise) and CCW (counterclockwise) directions or clickers that click only in one direction.

The present invention is generally characterized by placing a non-linear spring or combination of springs in the tool body to achieve multiple slope operation rather than using one single slope spring. The multiple slope configuration is superior in performance by moving closer to the ideal case of 0% error in operation. This low-error performance can be maintained with multiple slope configurations over the entire range of operation. The multiple slope configuration prolongs the life of the product as well as decreasing the need for recalibration as well as increasing the range of operation.

DESCRIPTION OF THE FIGURES

Attention is now directed to several illustrations that aid in understanding the features of the present invention:

FIG. 4A shows the softer spring being placed towards the push plate, while FIG. 4B shows the harder spring being placed towards the push plate. In both cases, the softer spring will be active in the initial zone only.

Several drawings and illustrations have been presented to aid in understanding the present invention. The scope of the present invention is not limited to what is shown in the figures.

DESCRIPTION OF THE INVENTION

The present invention generally places multiple slope and/or multiple offset spring mechanisms in torque wrenches and like tools. This leads to increased accuracy, increased useful life of the product, decreased need for recalibration and increased range of operation.

Figure 1A:
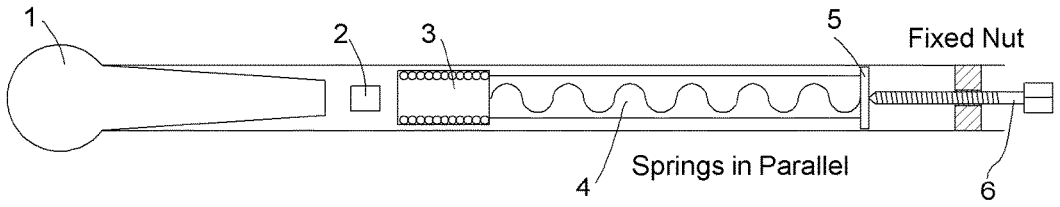
FIGS. 1A-1B show a tool with a parallel spring arrangement.
Figure 1B:
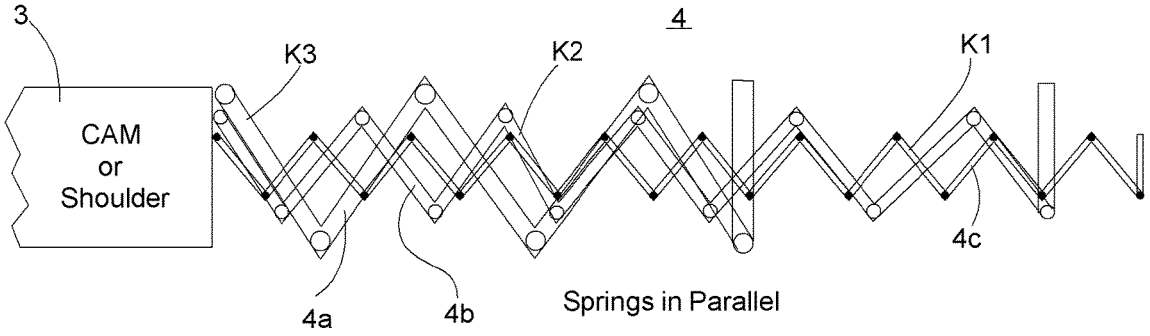

Turning to FIGS. 1A-1B, a tool handle can be seen in FIG. 1A with a diagram of a possible spring combination in FIG. 1B. A tensor 1 resides in front of a pivot block 2 and a cam 3. Several springs in parallel 4 are compressed by a push plate 5 that is driven by the adjusting screw 6. Schematically, in FIG. 1B, the spring mechanism 4 can be seen to include, in this case, three springs 4*a*, 4*b* and 4*c* arranged in parallel. The first zone of engagement only involves spring 4*c* with slope K1. In this zone, spring 4*c* acts linearly. At some point in the engagement, spring 4*b* also becomes engaged in parallel with spring 4*c*. In this second zone, the slope is K1+K2 (the two springs in parallel). Finally, the third spring 4*a* engages, and in this third zone, the effective slope is K1+K2+K3. The cam 3 is connected to all three springs. Generally K1<K2<K3; however, other combinations may be used.

Figure 2A:
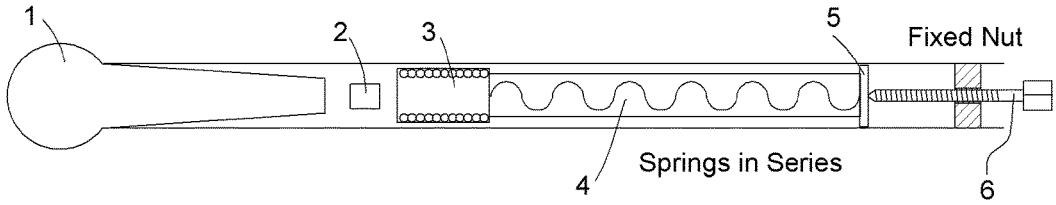
FIGS. 2A-2B show a tool with a series spring arrangement.
Figure 2B:
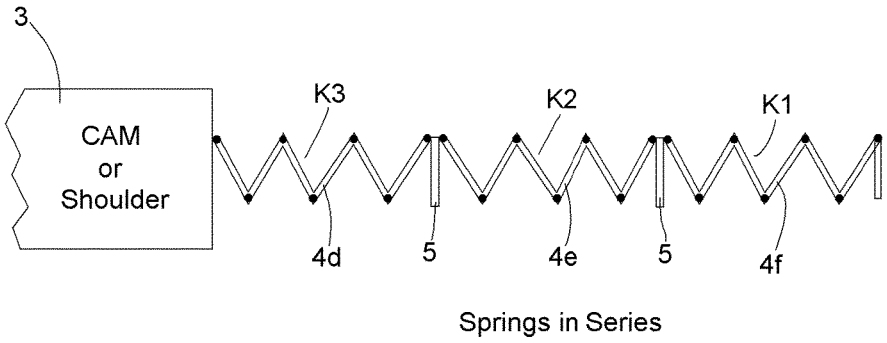

FIGS. 2A-2B show a similar arrangement to that of FIGS. 1A-1B except that the three springs 4*d*, 4*e* and 4*f* are connected in series. Here, the initial slope is K1*K2*K3/(K1*K2+K2*K3+K3*K1). Usually K1<K2<K3. In that case, after spring 4*f* is solid, the slope becomes K2*K3/(K2+K3). After springs 4*f* and 4*e* are both solid, the slope becomes K3. Optional push plates 5 or other devices can be placed between the springs. Again, a cam or shoulder 3 is connected to one end of the arrangement and a push plate 5 and adjusting screw 6 is located at the driven end.

Figure 3A:
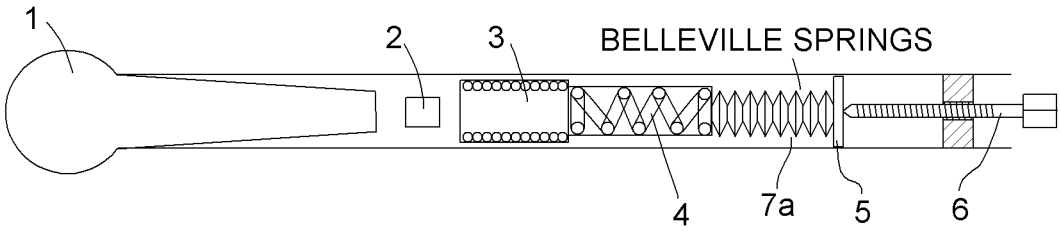
FIG. 3A shows a tool with a series Belleville spring arrangement.
Figure 3B:
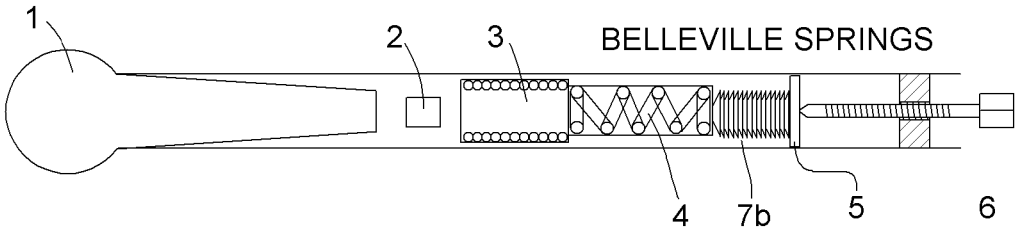
FIG. 3B shows a tool with an alternate series Belleville spring arrangement.

FIGS. 3A-3B show the use of well-known Belleville springs. Belleville springs are washer shaped disks that are distorted to be concave/convex along a axis through their center. These springs can be used in alternating directions to result in a stiffer spring arrangement 7*a* as shown in FIG. 3A, or used in an aligned direction to result in a weaker spring arrangement 7*b* as shown in FIG. 3B. In bath cases the Belleville spring is in series with the spiral spring 4. Again, there is a cam 3 and a push plate 5 at the ends. FIGS. 3A-3B generally show a combination where Belleville springs can be used in series with other springs. They can also be easily arranged to work in parallel with the spiral spring 4.

Figure 4A:
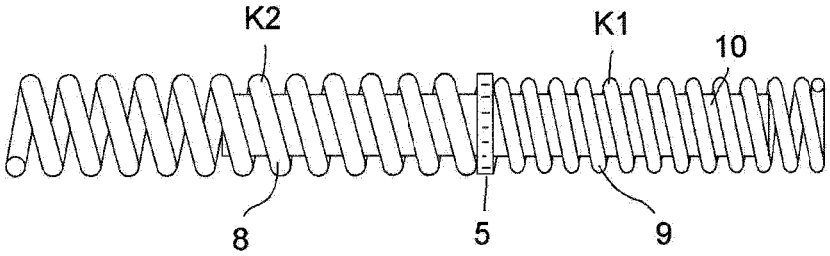
FIGS. 4A-4B show two compressive springs in series arrangement.
Figure 4B:
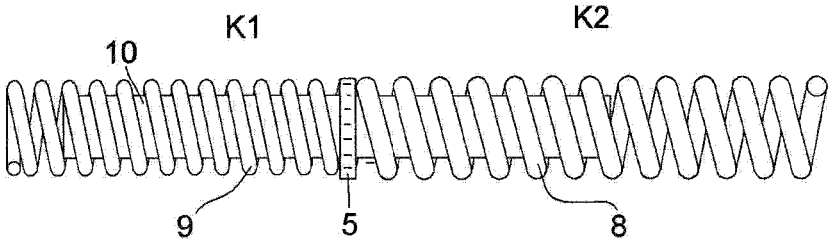

FIGS. 4A-4B show two spiral springs 8, 9 in a series arrangement. The softer spring has sprint rate K1, while the stiffer spring has spring rate K2 with K1<K2. FIG. 4A shows the softer spring 9 on the right and the stiffer spring 8 on the left. Initially both springs 8 and 9 contribute to the effective spring rate. Once the push plate (on the right side, not shown) touches item 10, spring 9 gets disengaged and only spring 8 contributes to the effective spring rate. FIG. 4B shows the two springs 8, 9 reversed so that the stiffer spring 8 is on the right side. A push plate or separator bush 5 separates the two springs. In this case both springs contribute to the effective spring rate. Once the cam/shoulder (on the left side, not shown) touches item 10 the softer spring 9 is disengaged and only the harder spring 8 will contribute to the effective spring rate. The separator bush 5, item 10, and the guide rod that goes inside the stiffer spring 8 can either be one integrated piece or individual parts. The guide rod that slides inside the stiffer spring 8 is not needed to function and is optional.

Figure 5A:
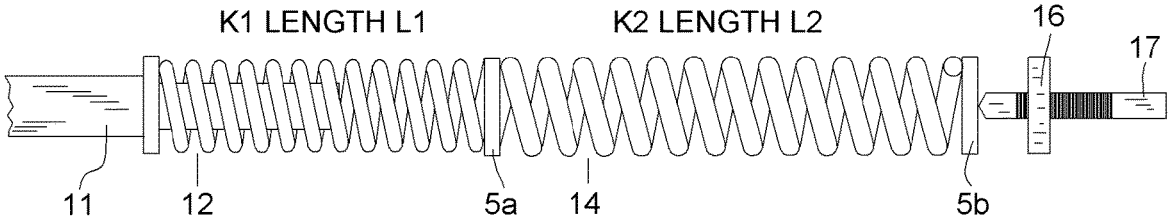
FIG. 5A-5B show a series arrangement of two springs with and without soft spring disengage guide.

FIG. 5A shows a tool arrangement like that of FIG. 4B with one exception. Here the item 10 is replaced with a part that acts as the cam/shoulder with integrated disengaging rod. Here, the softer spring 12 is designed so that once the separator plate 5*a* touches the right side end of item 11. After this, only the stiffer spring 14 will contribute to stiffness. A push plate 5*b*, screw 17, and nut 16 combination allows adjustment for setting the target torque.

Figure 5B:
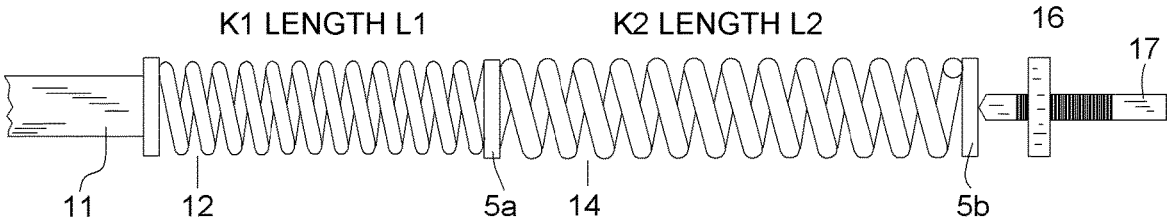

FIG. 5B shows a similar arrangement to 5A except that item 11 has no disengaging rod. Also, this configuration completely eliminates the need for a separator 5*a*. Here, initially both springs contribute to the effective stiffness of the spring. The softer spring 12 is so designed that it will become solid at the end of zone 1. In zone 2, only the stiffer spring 14 will contribute to stiffness. A push plate 5*b*, screw 17, and nut 16 combination allows adjustment. A cam or shoulder 11 is driven on the left.

Figure 6:
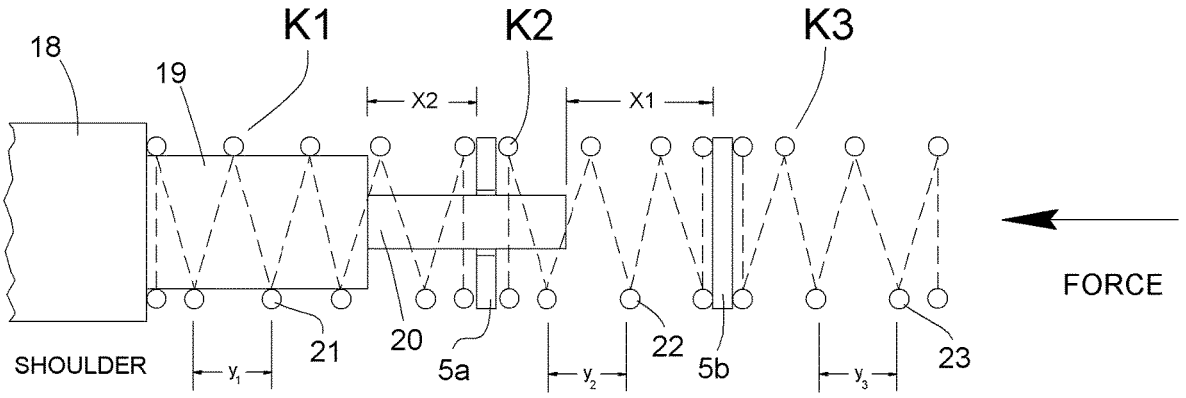
FIG. 6 shows an arrangement of three springs.

FIG. 6 shows an embodiment where a one-piece left shoulder 18, 19, 20 along with a washer-like disengage 5*a* and a spacer like disengage 5*b* provide the necessary mechanism to separate the three springs 21, 22 and 23, and at the same time, provide a way to disengage springs at the end of each zone of the compression stroke. The one-piece left shoulder has an exterior part 18 with the largest diameter, a center part 19 with a smaller diameter and an internal part 20 with the smallest diameter. The washer-like disengage 5*a* can generally slide along the internal part 20 of the shoulder. Each of the three springs has a spring constant K1, K2 or K3 and a coil pitch of y1, y2 and y3. The sliding disengage 5*a* is separated from the second part of the shoulder 19 by distance x2, while the spacer-like disengage 5*b* and the end of the internal part of the shoulder 20 are separated by distance x1 (in the initial state). In the case of K1<K2<K3, when loaded by the adjusting screw and push plate combination, spring K1 is disengaged first, followed by spring K2. In the third zone only spring K3 will remain active.

Figure 7:
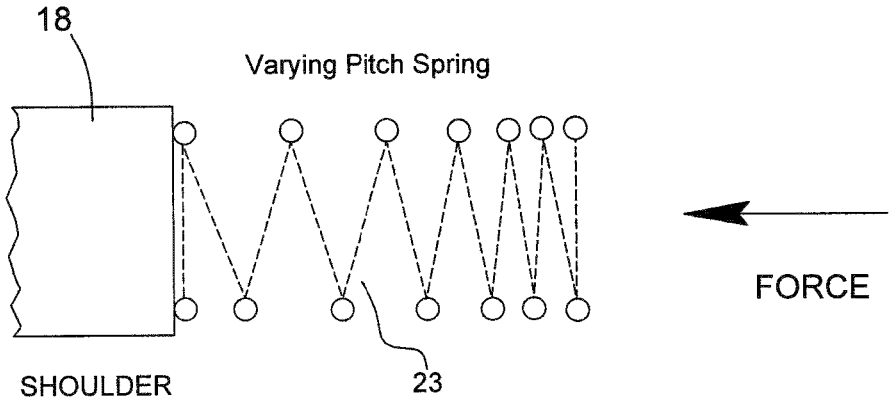
FIG. 7 shows a varying-pitch spring.
Figure 8:
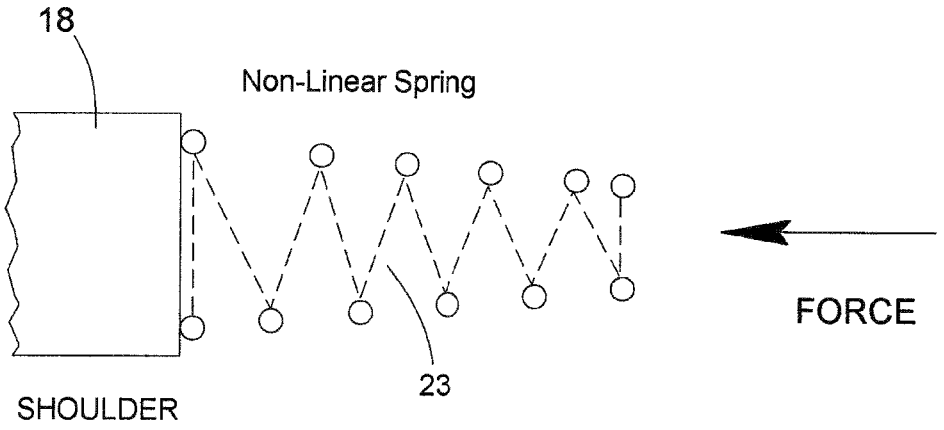
FIG. 8 shows a non-linear spring with varying spring diameter.

FIG. 7 shows a way to achieve a varying-slope spring using a non-linear spring. The non-linearity of the spring is due to the varying pitch of the spring 23 as shown. This spring gives a continuously varying slope as opposed to discrete multiple-slopes from separate springs. Optionally, the continuously varying slope can be achieved with multiple springs. FIG. 8 shows an alternate way to achieve a varying slope using one non-linear spring 23 using varying diameter. The non-linear spring arrangements shown in FIGS. 7-8 are known in the prior art.

Figure 9:
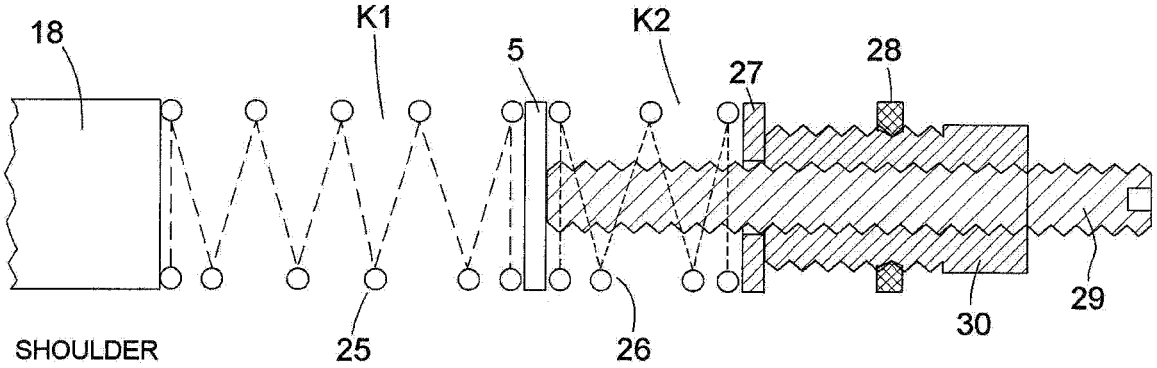
FIG. 9 shows an adjustable tool mechanism with two springs.

FIG. 9 shows an embodiment of a multiple-offset mechanism using two springs 25, 26. The initial offset of spring 26 with spring rate K2 is achieved by adjusting the outer screw 30 while holding the inner screw 29. The outer screw 30 has threads both inside and outside. The offset of spring 25 with constant K1 can be adjusted by rotating the inner screw 29 while holding the outer screw 30. A fixed nut 28 holds the screws 29 and 30 set. A first plate 27 engages spring 26, while a second plate 5 engages spring 25. By rotating 29 and 30 in various combinations, it is possible to achieve both multiple slopes and multiple offsets mechanisms.

Figure 10:
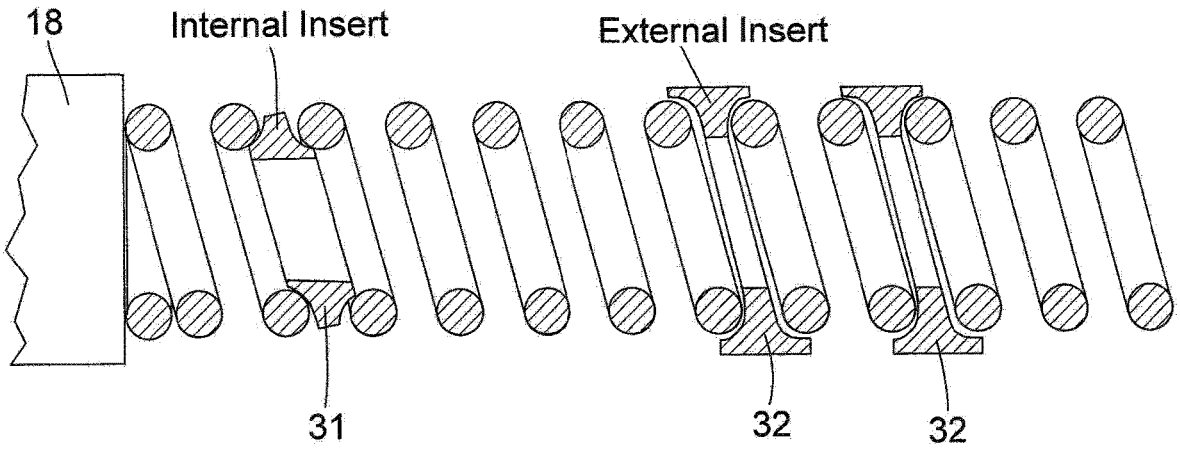
FIG. 10 shows internal and external inserts.

FIG. 10 shows two different possible spring inserts: internal and external. Spring inserts are used to cause a spring to become non-linear. Ore or more inserts can be used to achieve multiple slopes. An internal insert 31 maintains the same diameter as the spring, while an external insert 32 has a greater diameter.

Figure 11:
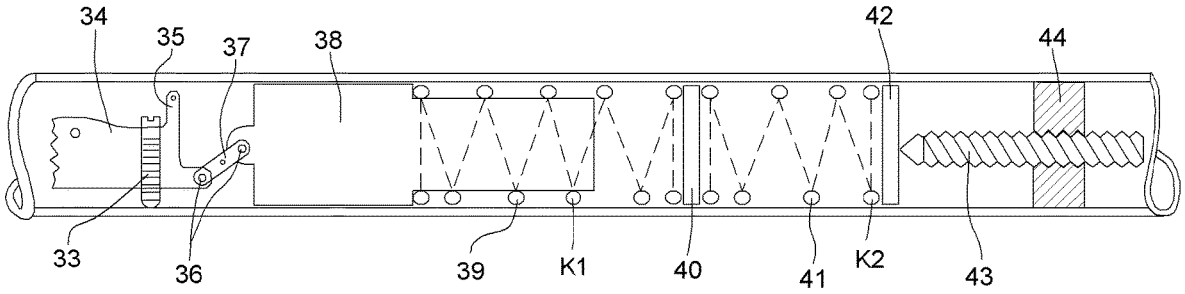
FIG. 11 shows an adjustable torque wrench mechanism using Links.

FIG. 11 shows an embodiment of a multiple slope and/or multiple offset mechanism applied to a mechanical clicker. There are two springs 39 and 41 with spring constants K1 and K2 where K2>K1. Spring 39 with K1 slides over the guide portion of the cam/shoulder 38 as shown. Spring 41 with K2 is positioned behind with a spring disengage plate 40 between the springs. The other end of spring 41 butts against a push plate that is driven by an adjusting screw 43. The adjusting screw 43 is threaded through a nut 44 whose outside surface is fixed to the tube through a pin or equivalent. The other end of the cam 38 is fitted with a link 37 through a link pin 36. The link 37 is free to rotate in the plane of the paper as shown in FIG. 11. The other end of the link 37 is engaged with a torque head or hinge 34. The torque head 34 has a set screw 33 that can be adjusted to position the link in a particular angle relative to the axis of the tube. On the top side of the torque head 34 there is a boss 35 that hits the tube when the clicker clicks.

In typical operation, the unit is first set to a target torque by rotating the adjusting screw 43 until the spring combination is compressed to a specific length thereby exerting a force on the link 37. As the driving end of the torque head or hinge 34 is used to tighten a fastener, the reaction torque tries to tilt the hinge 34 upward since it is pivoted near the drive end. However, the link 37 will not allow this to happen since it is under compression and exerts a force that opposes the tilting of the hinge 34. However, as the applied torque is increased to the target torque, the tilting force exceeds the resistive force applied by the compressed spring. At this point, the hinge tilts or "clicks" by compressing the spring further, and the link 37 tends to align with the axis of the tube. However, before the link can completely straighten, the boss 35 of the hinge hits the tube and stops further straightening of the link 37 along the axis of the tube.

The operation of the springs is similar to springs in series. In zone 1 of compression stroke, both springs contribute to the effective spring stiffness. At the end of zone-1, the spring 39 with K1 is disengaged since the spring separator 40 touches the guide end surface of the cam 38. In zone-2, only spring 41 with K2 will contribute to the stiffness. This mechanism thus provides two selectable slopes.

The embodiment shown in FIG. 11 is for two springs; however, the concept can easily be extended to more than two springs and multiple offsets. Similarly the single link shown here can easily be obtained by other mechanical means known in the art, but the fundamental concept of continuous adjustment of link's height to width ratio remains the same.

Figure 12:
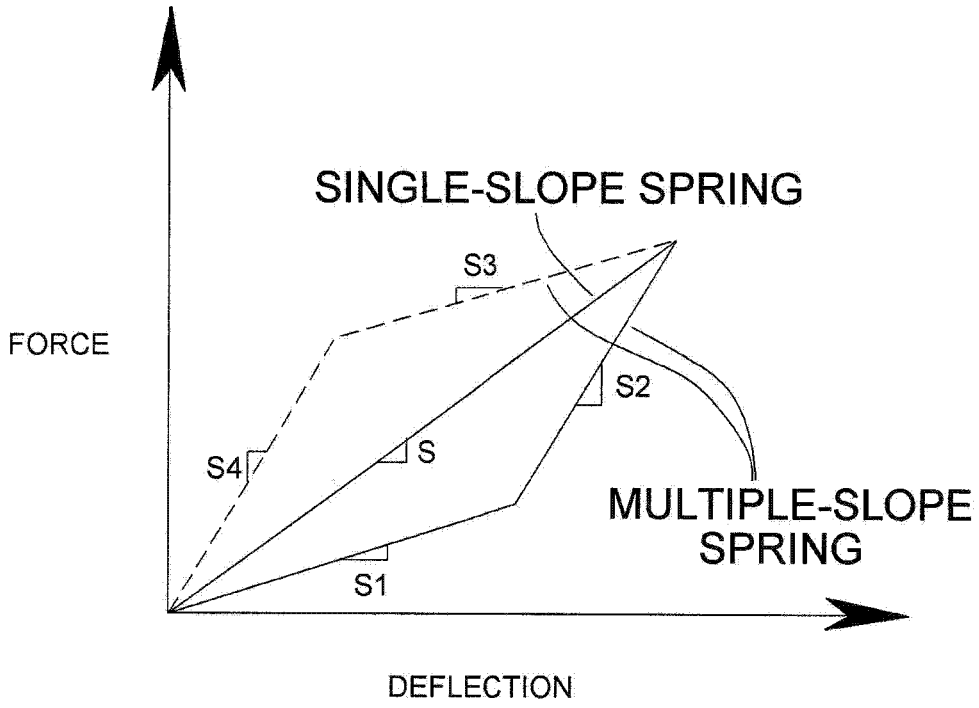
FIG. 12 is a graph of single-slope and multiple-slope spring mechanisms.

FIG. 12 shows a graph of deflection vs. force for both a single-slope spring and for multiple-slope springs. Two slope combinations can be arranged to take either S1-S2 or S4-S3 path to reach 100% rated capacity.

Figure 13:
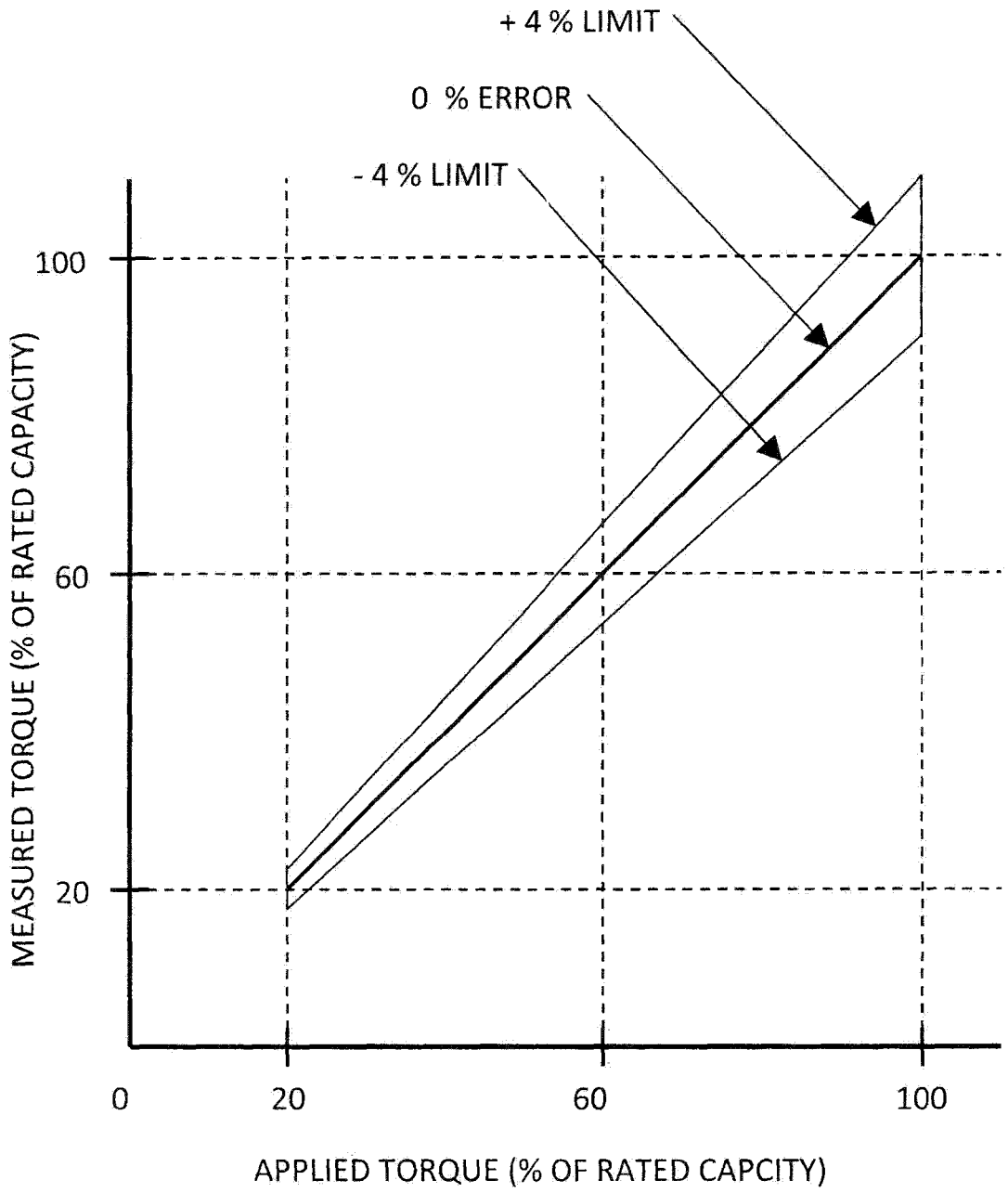
FIG. 13 is a graph of applied torque vs. applied torque with different error limits.

FIG. 13 shows a typical error zone (+/−4% of rated capacity) for a clicker type torque wrench. Typically the accuracy is defined over the range of 20% to 100% of rated capacity as shown in this FIG. 13. This accuracy has to be maintained throughout its normal life of operation. Typically the life of a torque wrench is defined by an ASME or similar standard for mechanical torque wrench products, where for example the unit has to maintain its stated accuracy for 5000 cycles of full load of rated capacity in each claimed directions (clockwise and counter clockwise) followed by typically 125% overload. After these two steps, the unit should withstand 20,000 or more cycles at half load of rated capacity in each claimed direction. However the unit does not have to be in calibration after the last step. Also, the unit must not suffer any physical damage in any of the three steps.

Figure 14:
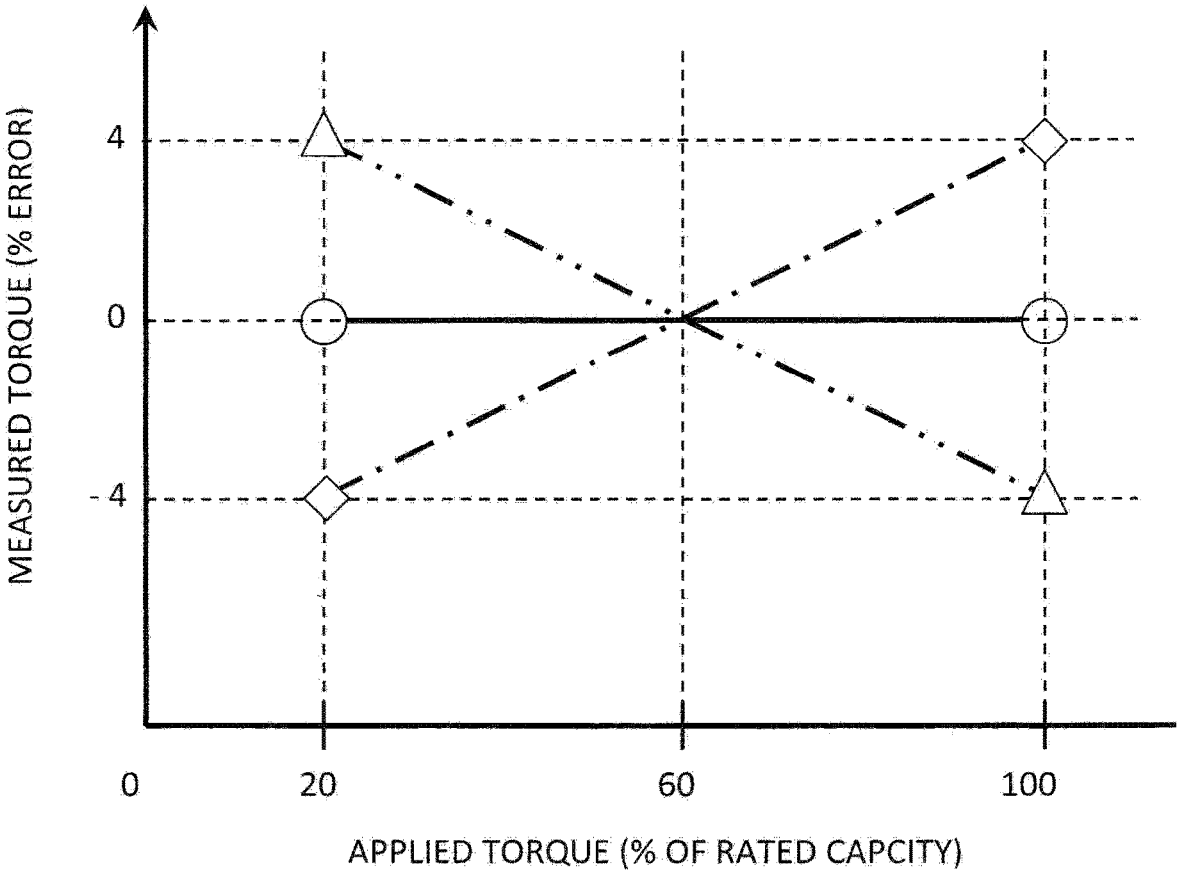
FIG. 14 is a graph of applied torque (% of rated capacity) vs. measured torque (% error).

It is a challenge to achieve this performance economically due to the limitations of the single slope mechanism used in prior art devices. For example, FIG. 14 shows the limits of error zone acceptable when the product is brand new. The line showed in the middle with 'circle symbol' represents the 'best case scenario' when all the parts in the unit are perfect and the slope of the unit aligns exactly with the slope of the zero error line. Similarly the line with 'diamond symbol' represents the 'worst case scenario' of a brand new unit. Here the error at 20% rated capacity (20-RC) is −4% whereas the error at 100% rated capacity (100-RC) is +4%. In such cases, when the unit undergoes normal usage, it will go out of calibration very quickly due to wear and tear of various components of the unit. Similarly, the line with triangle symbol also represents another worst case scenario where the error at 20-RC is +4% and the error at 100-RC is −4%. Most units, however, fall somewhere between the two worst t cases.

Figure 15:
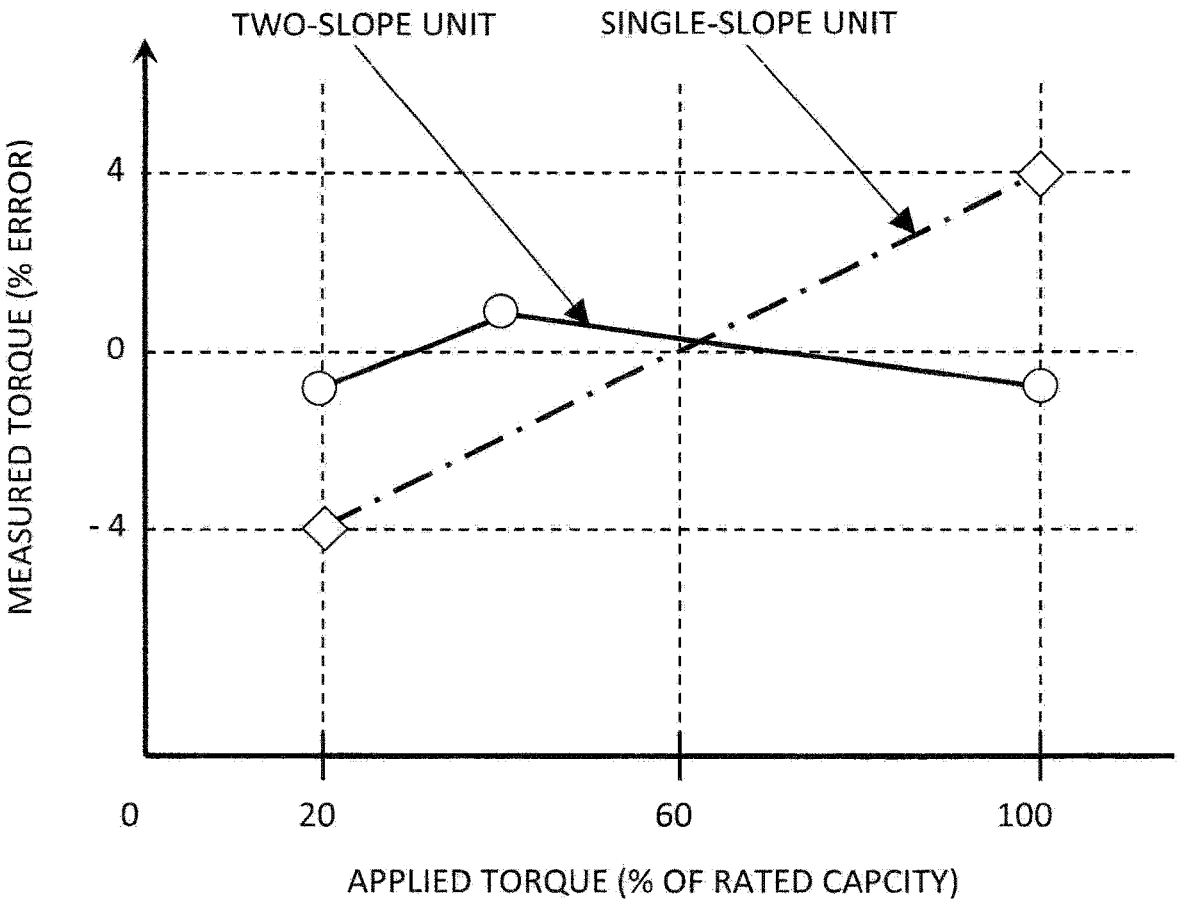
FIG. 15 is a graph like that of FIG. 14 showing a single-slope and multiple-slope configuration.

The present invention using multiple slope and/or multiple offset mechanisms for torque wrenches and similar tools provides a new flexibility to move closer to the ideal case of 0% error. For example, FIG. 15 shows where, by using two-slopes, it is possible to stay closer to 0% error in the entire range of operation. Again, the diamond symbol represents the worst case scenario of single slope unit. The circular symbol represents a unit with two-slopes where it is much easier to reduce the error during manufacturing and hence decrease the chances of loosing accuracy prematurely before its expected useful life. In FIG. 15, the unit switches over from the $1^{st}$ slope to $2^{nd}$ slope at approximately 40% or rated capacity.

By increasing the number of slopes and/or offsets one can achieve almost ideal case of 0% error during manufacturing and hence can prolong the useful life of the product. No matter what mechanism is used to generate the multiple-slope and/or multiple-offset features, the methodology needed to convert a single-slope and/or single-offset mechanism to multiple-slope and/or multiple-offset mechanisms does not change from what is described in the present invention.

As previously stated, the present invention leads to increased accuracy, increased useful life of the product, decreased need for recalibration and increased range of operation.

Figure 16A:
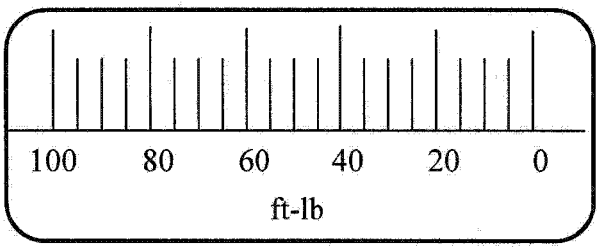
Prior Art FIG. 16A
FIGS. 16A, 16B and 16C show torque wrench scales, both linear and non-linear.

A typical prior-art mechanical torque wrench has a linear scale, as shown in FIG. 16A, where the markings are equidistant since the springs in prior art mechanical clicker torque wrenches has one spring with one slope for the entire operating region.

Figure 16B:
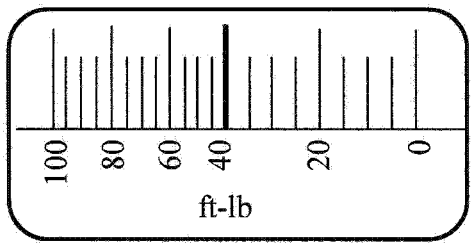

The present invention however uses multiple slopes and therefore needs a non-linear scale where the markings are not equidistant for the entire range of operation. FIG. 16B shows a scale that is suitable for a 2-slope 100 foot-pound tool mechanism. Here the markings from 0 to 40 foot-pounds are equidistant indicating that two springs are contributing to the effective spring rate. At 40 foot-pound mark, the softer spring is disengaged and only stiffer spring will contribute to the effective spring rate of the mechanism. Therefore the markings from 40-100 foot-pounds is equidistant, but different from 0-40 foot-pounds. To implement this in practice, the scale could be custom generated for each unit and positioned at the desired offset. The above example is for a case where the first slope is lower than the second slope, since the softer spring is disengaged after completing the first range. It is also possible to reverse this process so that the first slope is greater than the second slope by disengaging the stiffer spring after the first range.

Figure 16C:
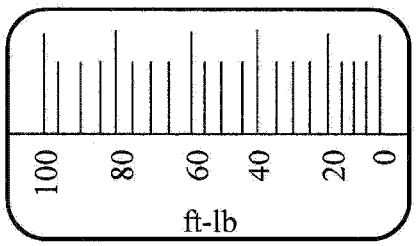

FIG. 16C shows a sample non-linear scale suitable for a continuously varying non-linear spring such as the one shown in FIGS. 7 and 8.

Figure 17:
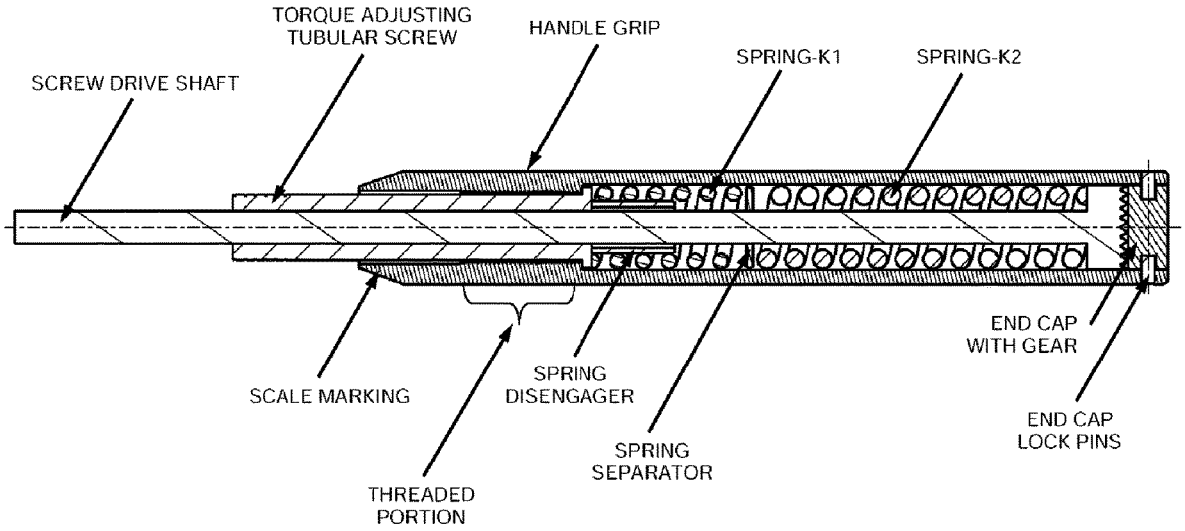
FIGS. 17 and 18 show a torque screwdriver with a multiple slope mechanism.
Figure 18:
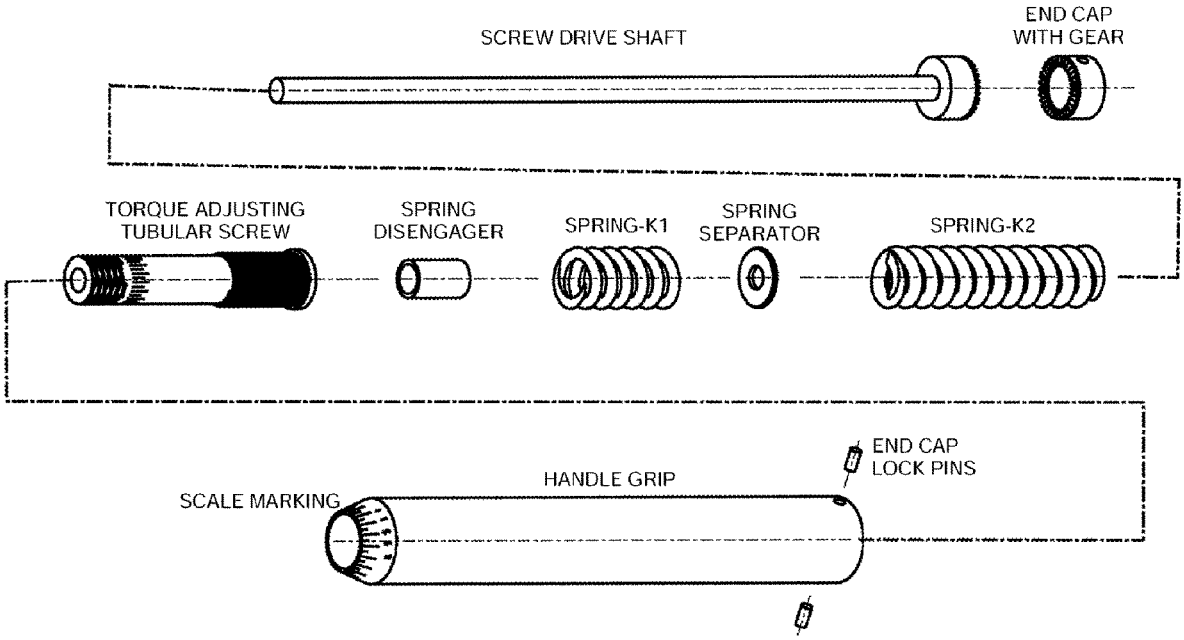

FIGS. 17 and 18 show a 2-slope configuration of a clicker type torque screwdriver. The screw drive shaft has a socket or some other mechanism to drive a screw that is not shown. On the other end, it has radial gears that closely mesh with the end cap with gear. A torque adjusting tubular screw rides over the screw drive shaft when it is rotated relative to the handle grip. The threaded portion of the tubular screw engages the thread inside the handle grip as shown in FIG. 17. To facilitate rotation, the end of the screw drive shaft is knurled on outside for a short distance. This adjusting screw engages the spring K1 and the inner tube-like spring disengager. The two springs are separated by an annular shaped spring separator.

In normal operation, the user sets the target torque by rotating the tubular screw while holding the handle grip. The spring is compressed, and the spring applies force to the back end of the screw drive shaft. As the user applies torque to a screw, the spring force applied between the back end of screw drive shaft and tubular screw keeps it from slipping over the radial gears present in the drive shaft and end cap with gear. Once the torque reaches the set target torque value, the spring force is not sufficient to hold the radial gears together, and the two radial gears slip so that no additional torque can be applied to the screw.

A double spring mechanism works exactly like the one described above for a clicker type torque wrench. FIG. 18 shows an exploded view of a double spring mechanism that shows the details of each part, and their orientation, before assembling the product. Although only one configuration is shown here, there are many alternative design torque screwdrivers to which the multiple slope or multiple offset mechanism of the present invention can be easily applied and which are within the scope of the present invention.

Several descriptions and illustrations have been presented to aid in understanding the present invention. One with skill in the art will realize that numerous changes and variations are possible without departing from the spirit of the invention. Each of these changes and variations is within the scope of the present invention.

The invention claimed is:

1. A method of improving performance of a torque tool comprising:

placing a multiple-slope spring system in a torque tool barrel wherein said multiple-slope spring system is adjustable to a specified target torque, said multiple-slope spring system causing said torque tool to release when said target torque is reached;

placing three springs S1, S2 and S3 of different lengths L1, L2 and L3 in parallel in a torque wrench barrel, wherein L1>L2>L3, and wherein S1 has a spring constant K1; S2 has a spring constant K2; and S3 has a spring constant K3 with K1<K2<K3;

constructing the torque tool so that as the torque tool is compressed, spring S1 engages first in a first zone resulting in a spring constant of K1 in the first zone; as the torque tool is further compressed, spring S2 engages along with spring S1 in a second zone resulting in a spring constant of K1+K2 in the second zone; and as the torque tool is still further compressed, spring S3 engages along with spring S1 and spring S2 in a third zone resulting in a spring constant of K1+K2+K3 in the third zone;

constructing the torque tool so that a push plate compresses springs S1, S2 and S3 as the torque tool is compressed, said push plate being driven by an adjusting screw;

constructing the torque tool so that as springs S1, S2 and S3 are compressed, an increasing amount of torque is continuously displayed on an indicator, or constructing the torque tool so that all torque is released when all three springs are compressed by a predetermined amount.

2. The method of claim 1 wherein said torque tool is a torque wrench.

3. The method of claim 1 wherein at least one of springs S1, S2 or S3 is a non-linear spring.

* * * * *